US005431479A

United States Patent [19]

Leib

[11] Patent Number: 5,431,479

[45] Date of Patent: Jul. 11, 1995

[54] TANDEM CHAIR ASSEMBLY

[76] Inventor: Roger K. Leib, 1064 Crescent Heights, Los Angeles, Calif. 90035

[21] Appl. No.: 55,804

[22] Filed: Apr. 29, 1993

Related U.S. Application Data

[63] Continuation of Ser. No. 833,802, Feb. 2, 1992, which is a continuation of Ser. No. 536,441, Jun. 11, 1990.

[51] Int. Cl.[6] ..... A47C 4/00

[52] U.S. Cl. ..... 297/232; 297/248; 297/440.23

[58] Field of Search ..... 297/232, 248, 411.44, 297/440.23

[56] References Cited

U.S. PATENT DOCUMENTS

| | | | |
|---|---|---|---|
| D. 220,389 | 4/1971 | Krommer | 297/248 |
| D. 244,974 | 7/1977 | Settee . | |
| D. 247,012 | 1/1978 | Lubke | D6/63 |
| D. 266,038 | 9/1982 | Raftery et al. . | |
| 1,351,995 | 9/1920 | Cornish | 297/232 |
| 1,657,285 | 1/1928 | Siskin | 297/232 |
| 1,842,054 | 1/1932 | Sobel | 297/232 |
| 2,447,391 | 8/1948 | Brandes et al. | 297/135 |
| 2,905,230 | 9/1959 | Gabriel | 297/410 |
| 3,124,390 | 3/1964 | Eames et al. | 297/232 |
| 3,131,970 | 5/1964 | McGregor | 297/445 |
| 3,327,982 | 6/1967 | Kromer | 248/188 |
| 3,515,430 | 6/1970 | Nelson | 297/219 |
| 3,874,729 | 4/1975 | Blodee | 297/411.44 |
| 4,097,089 | 6/1978 | Petersen | 297/440 X |
| 4,114,949 | 9/1978 | Benoit | 297/232 |
| 4,265,483 | 5/1981 | Raftery et al. | 297/232 |
| 4,311,337 | 1/1982 | Brunn | 297/440 X |
| 4,492,409 | 1/1985 | Laird | 297/440 |
| 4,848,843 | 7/1989 | Gibbs | 248/188 |
| 4,858,996 | 8/1989 | Blodee | 297/232 |
| 4,919,485 | 4/1990 | Guichon | 297/440 X |

FOREIGN PATENT DOCUMENTS

| | | | |
|---|---|---|---|
| 931526 | 10/1947 | France | 297/232 |
| 2736845 | 1/1979 | Germany | 297/232 |
| 697386 | 9/1953 | United Kingdom | 297/411.44 |

*Primary Examiner*—Kenneth J. Dorner
*Assistant Examiner*—Cassandra Davis
*Attorney, Agent, or Firm*—Sheldon & Mak

[57] ABSTRACT

A tandem chair assembly comprises a frame, a plurality of seating units, and an optional integral table. The frame comprises a pair of opposed legs and a horizontal beam extending between and attached to the end legs. Rigid seating units comprising a seat support section and a back support section are positioned side-by-side between the legs with their fronts supported on the beam. Seat connection plates secure the front of the seat support section of each seating unit to the horizontal beam. In addition brackets are used for rigidly connection each leg to the back support section of the seating unit next to the leg. Further, the back support sections of each adjacent pair of seating units are rigidly connected together, and the seat support section and back support section are maintained at right angles by means of right angle struts that double as arm rests.

33 Claims, 3 Drawing Sheets

TANDEM CHAIR ASSEMBLY

This application is a continuation of application Ser. No. 07/833,802, filed Feb. 2, 1992, which is a continuation of application Ser. No. 07/536,441 filed Jun. 11, 1990.

BACKGROUND

The present invention is directed to a tandem chair assembly.

There are many uses, particularly commercial uses, for tandem chair assemblies where two or more chairs are mounted together side-by-side. Tandem chair assemblies are found in institutions of all kinds such as airports, hospitals, and waiting rooms of doctors, lawyers, dentists, and other professionals. One reason for the popularity of tandem chair assemblies is that on a per seat basis they are less expensive than individual chairs. Other reasons for their popularity compared to using a plurality of single chairs is they remain arranged in a given configuration, they tend to take up less floor space, and they can have fewer floor supports.

Many commercially available tandem chair assemblies suffer from disadvantages. Many of them are lacking in aesthetic appeal, having an overall clumsy or piecemeal appearance. Further, they tend to be uncomfortable, lacking padding and a contoured shape for comfort.

A further problem with many tandem chairs is the cost of shipping. They can be long, bulky, heavy structures, occupying a large amount of space in a carrier or transportation vehicle.

Another fault with tandem seating is that it can be difficult to clean under because of the multiplicity of floor supports required, i.e., it can be difficult to vacuum under seating having a large number of legs.

Many tandem seating arrangements lack flexibility: one structure is used for two seats, another structure for three seats, and yet another for four seats. This results in increased manufacturing costs and difficulties in maintaining inventory.

Also in many applications it would be desirable to provide the tandem chair assembly with an integral table for reading lamps, reading materials, and the like. Many available tandem chair assemblies do not have such a table available as an integral part of the structure.

Accordingly, there is a need for a tandem chair assembly that is aesthetic in appearance; that is inexpensive to manufacture; that is comfortable to sit in; that has minimal floor supports; that can be configured to be shipped in a knocked-down, assemble-in-the-field configuration; that is light weight; that is easily adaptable to accommodate two, three, or more seating units or single units when required as part of an overall design scheme; that has a removable cover; and that can optionally be provided with one or more tables.

SUMMARY

The present invention provides a tandem chair assembly that can satisfy these needs. The chair assembly is formed from a combination of contoured seat/back shells and metal frame members that create a unique, modular structure. The chair assembly comprises a frame and a plurality of seating units supported by the frame. The frame comprises a pair of opposed legs, a horizontal, under-the-seat beam extending between the legs, and means for attaching the legs to the horizontal beam. The seating units are positioned side-by-side between the legs. Each seating unit has a back support section, preferably contoured, and a seat support section.

The bulk of the structural support for the span between the legs is provided by an "integral" beam. The integral beam is formed by the substantially rigid seating units, and particularly the back support sections, which are rigidly interconnected to each other by connectors such as middle brackets, i.e., adjacent back support sections are rigidly connected together by a middle bracket that comprises a back connection plate. This assemblage creates a structure with rigidity to loads imposed in a vertical direction (parallel to the plane of the back support sections) whose load bearing capability in the vertical direction derives from and is proportional to the spacing between the points of rigid interconnection between adjacent seat backs. The two seating units at the ends of the tandem chair assembly, i.e., the ones next to the legs, are attached to the leg by an end bracket.

For rigidity of the structure in the transverse direction, i.e., horizontally and parallel to the plane of the seat, preferably each middle bracket includes a seat connection member or plate that is attached to (i) the horizontal beam and to (ii) the seat support sections of the two seating units to which the bracket is connected at the back support sections. This restrains the beam in a vertical orientation, preventing twist in the beam so as to maximize its load bearing capabilities. The beam serves to resist vertical loads imposed on the seat fronts. Because the beam is connected rigidly to the legs, lateral stability of the chair assembly is achieved in conjunction with the end brackets. Preferably the seat support section of each seating unit is secured to the horizontal beam toward the front edge of the seat.

To resist rotation of the seat and back of each seating unit from the substantially right angle orientation of one to the other, each middle bracket can include a stiff brace or strut to maintain the relative substantially right angle orientation. The brace can comprise a rigid frame member spanning between the seat connection plate and the back connection plate. The brace preferably includes a substantially horizontal section to serve as an arm rest.

Preferably the seating units are comprised of a formed wooden shell where the back support sections are configured to provide good lumbar support.

For stability and aesthetics, preferably each leg comprises a substantially rectangular loop having a top horizontal segment, a bottom horizontal segment, and two vertical segments. The bottom horizontal segment sits on the floor and the top horizontal segment is positioned to serve as an arm rest.

Preferably the seating units are identical and interchangeable. Thus merely by changing the length of the horizontal beam, it is possible to increase or decrease the number of seating units in the tandem chair assembly. All that is needed to add an additional seating unit is to have a longer horizontal beam, and to add one additional middle bracket and associated hardware.

The tandem chair assembly includes one or two optional table assemblies. Each end table assembly comprises a table projecting laterally from one of the legs and table attachment means for attaching the table to the chair assembly. The attachment means can comprise a horizontal front table beam rigidly cantilevered off of the leg, and a rear table beam rigidly cantilevered and extending from the underside of the seat portion of one of the end seating units. The rear table beam tends to be at a lower elevation than the front table beam because the seating section of each chair unit slopes rearwardly for comfort. Accordingly, preferably leveling means such as spacers are provided on the rear table beam so that the table is substantially horizontal.

Preferably each seating unit comprises foam attached to the wooden shell for comfort, and a removable cover for an attractive appearance. The cover can comprise pockets to accommodate the middle brackets and the end brackets at the location where they are attached to the back support section of each seating unit.

This tandem chair assembly has a simple construction, has an aesthetic minimalistic appearance, is comfortable to sit in, is lightweight and can be shipped in a small volume knocked-down form. Moreover, it is easily increased or decreased in size due to the use of interchangeable seating units, and can be provided with an end table. Thus this tandem chair assembly satisfies the need in the marketplace for such a tandem chair assembly.

DRAWINGS

These and other features, aspects, and advantages of the present invention will become better understood with reference to the following description, appended claims, and accompanying drawings where:

DESCRIPTION

Figure 1:
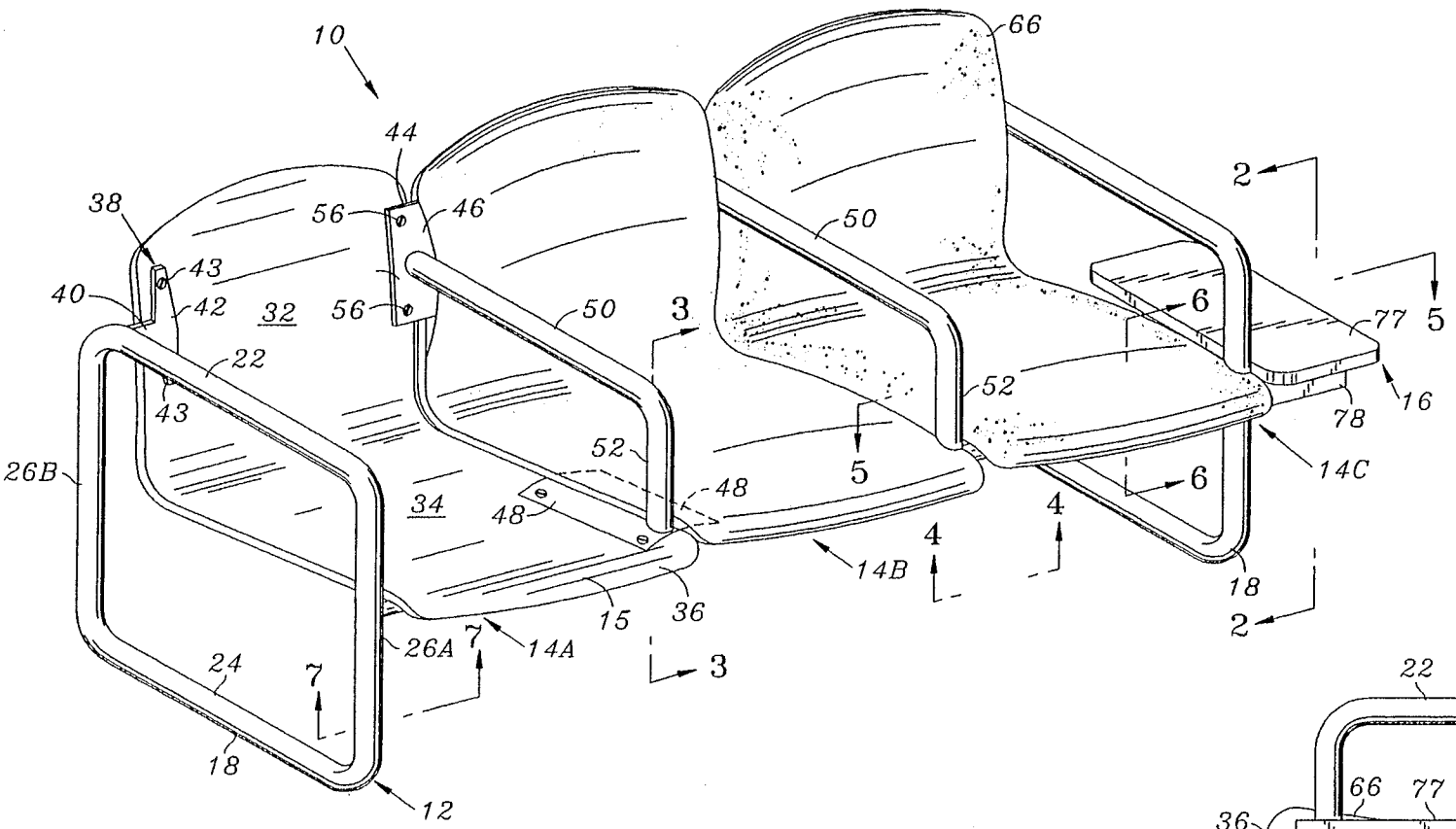
FIG. 1 is a perspective view of a tandem chair assembly embodying features of the present invention, the seating assembly having an optional end table.

With reference to the drawings, a tandem chair assembly 10 embodying features of the present invention comprises a frame assembly 12, a plurality of seating units 14 support by the frame assembly 12, and an end, corner, or mid-connector table assembly 16 attached to the frame assembly 12.

The frame assembly 12 comprises a pair of opposed legs 18 and a horizontal beam 20 supported by and extending between the legs 18. The legs 18 are referred to herein as "end" legs, although they are not necessarily at the ends of the assemblies such as where a table or additional seating unit is attached thereto. Each end leg 18 preferably is in the form of a substantially rectangular loop for stability and aesthetics. The loop comprises a top horizontal segment 22, a bottom horizontal segment 24 which sits on a floor surface, and two connecting vertical segments 26, a front segment 26A and a rear segment 26B. Preferably each end leg 18 is formed of a single piece of generally circular tubular metal that is bent to form the loop configuration. Preferably the top horizontal segment 22 of each end leg 18 is at a sufficiently high elevation to serve as an arm rest.

Figure 2:
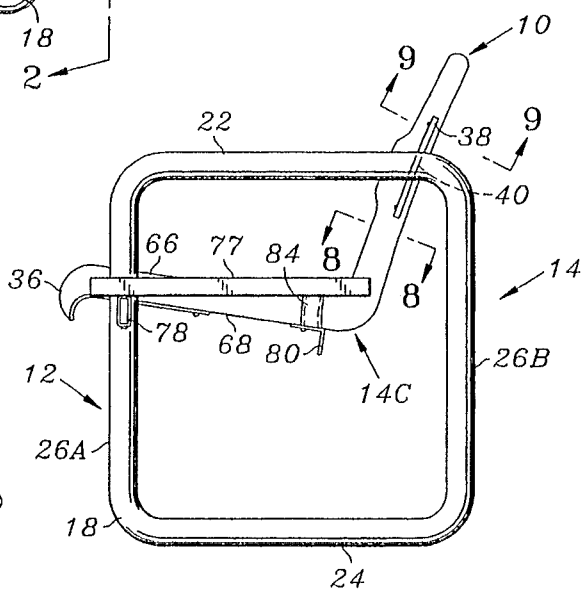
FIG. 2 is a side elevation view of the assembly of FIG. 1 taken on line 2—2 of FIG. 1.
Figure 3:
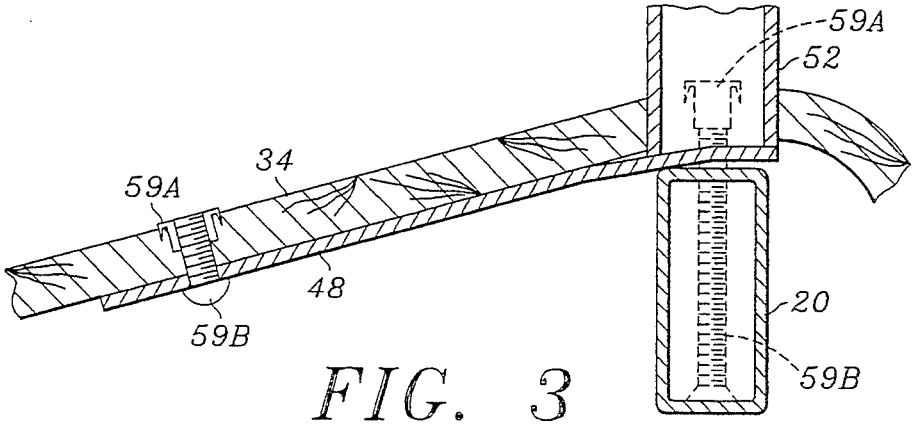
FIG. 3 is a vertical section view of a portion of the chair assembly of FIG. 1 taken on line 3—3 of FIG. 1 showing a section between the center arm bracket and the under-seat front beam.
Figure 6:
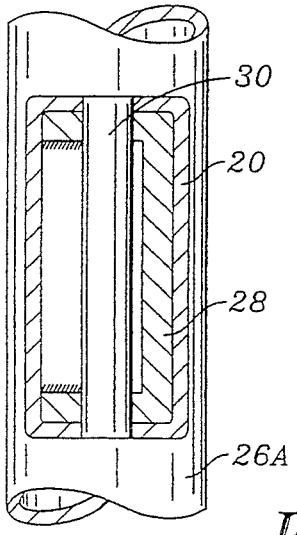
FIG. 6 is a vertical sectional view of the chair assembly FIG. 1 taken on line 6—6 in FIG. 1 showing how the beam is secured to a leg.
Figure 7:
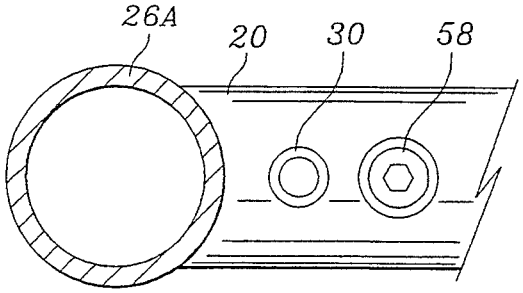
FIG. 7 is a bottom plan view partly in section, of the chair assembly of FIG. 1 taken on line 7—7 of FIG. 1, also showing how the under-the-seat beam is connected to a leg.
Figure 8:
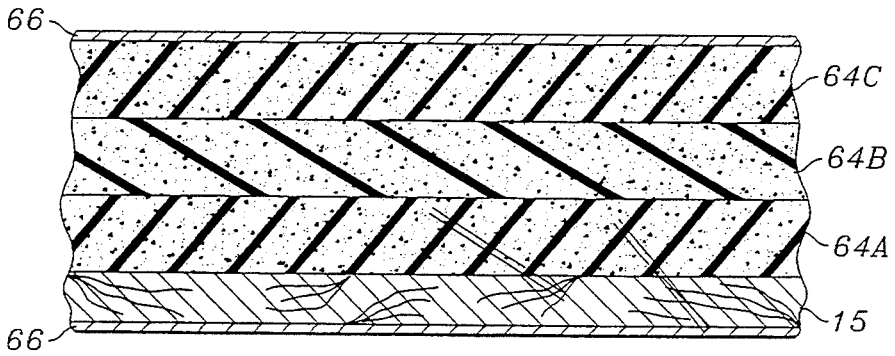
FIG. 8 is a vertical sectional view taken on line 8—8 of FIG. 2 showing the fabric/foam/wood structure of a seating unit.

With reference to FIGS. 2, 6, and 7, the under-the-seat horizontal beam 20 is supported and attached to the end legs 18 by means of a bracket, such as a "C" shaped bracket 28, welded to the inside of the front vertical segment 26A of each end leg 18. The beam 20, which can be rectangular in vertical cross-section, is mounted over the C-bracket 28 and is prevented from slipping out of place by a pin 30 that extends through aligned holes in the horizontal arms of the C-bracket and the beam 20. Thus the frame assembly 12 can be shipped unassembled and the end legs 18 can easily accommodate beams 20 of varying length.

Each seating unit 14 comprises a contoured, rigid shell 15, having a back support section 32 and a seat or derriere support section 34. In the version of the invention shown in FIG. 1 there are three seating units identified, left to right, as seating units 14A, 14B, and 14C. Seating units 14A and 14C are end seating units and seating unit 14B is a middle seating unit. The chair assembly 10 can have as few as one seating unit 14, or more than three seating units, where additional middle seating units are added as required.

As best shown in FIG. 2, the seating units 14 are contoured for comfort. The seat support section 34 has a front curved lip 36 which provides support to the back of the legs of a person seating on the chair, eliminates any edges which might compromise blood flow to the legs, and also serves to cover or hide the beam 20, adding to the aesthetics of the assembly 10. The seat support section 34 is tilted downwardly towards the rear, and the back support section 32 extends upwardly from the rear of the seat support section 34 at approximately a right angle. The back support section 32 is contoured and curved to provide good back support, particularly in the lumbar region.

Figure 4:
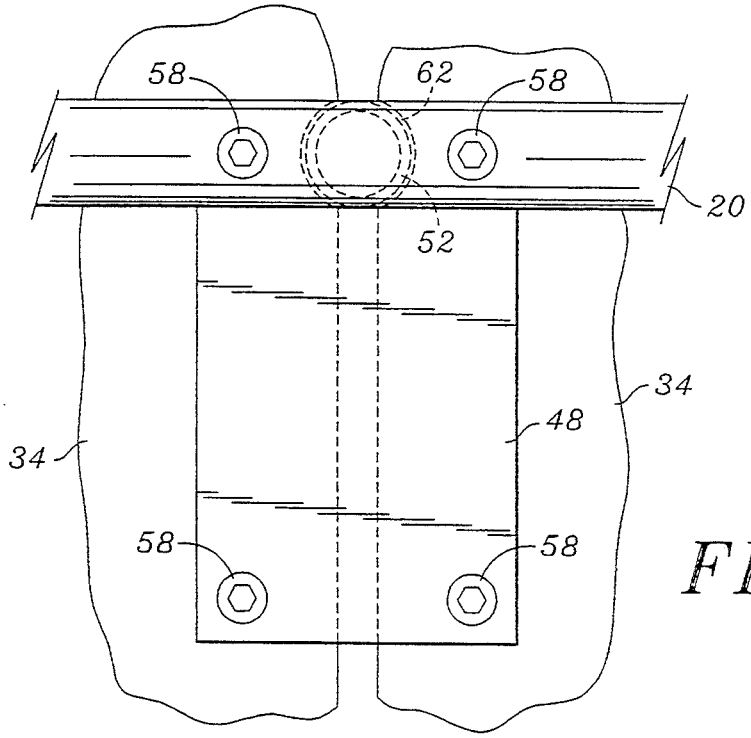
FIG. 4 is a partial bottom plan view of the tandem chair assembly of FIG. 1 taken on line 4—4 of FIG. 1.

The seating units 14 are supported by the beam 20 by having the front portion of the seat support section 34 of each seating unit 14 sit on top of the beam 20. The seating units 14 are positioned side-by-side, as shown in FIG. 4, and are very close together, being spaced apart by only a small distance of about $\frac{1}{2}$ inch.

The seating units are preferably of monocoque construction, and are formed of a rigid material, preferably plywood that has been laminated into the desired configuration. It is possible to use other rigid materials rather than plywood, such as rigid, moldable plastics. The remaining structural components of the chair assembly 10 are preferably fabricated of metal, such as cold rolled steel, which has been finished to provide an aesthetic appearance.

Each end seating unit 14A and 14C is rigidly connected to the top horizontal segment 22 of its respective end leg 18 by means of an end bracket 38 that is configured and positioned like a "T" on it side. A leg or tab portion 40 of the T bracket 38 projects horizontally and is welded to the end leg 18, preferably in a gap between the two ends of the tube used to form the end leg 18, as best shown in FIG. 2. The head portion 42 of the end bracket 38 is oriented vertically and secured to the seating unit 14 by fastening means 43. The depth of the head portion is tapered toward the end leg so that the bracket has a slim profile for aesthetic purposes. The fastening means 43, and for that matter, all fastening means used for fastening a wooden part of the chair assembly 10, can be a T-nut and screw combination, such as a T-nut 43A mounted in the seating unit 14 and a screw 43B (see FIG. 9) threaded through the bracket 38 into the T-nut 43A.

Where the seating units 14 are adjacent to each other, a middle bracket assembly 44 is used to (i) rigidly hold the seating units together, (ii) to secure the seating units to the beam 20, (iii) to maintain the orientation of the seat to the back at a right angle, and (iv) to provide an arm rest. These functions can be provided by separate elements, but for ease of fabrication and construction, a single middle bracket assembly 44 is used. Thus there is a middle bracket assembly 44 between seating units 14A and 14B, and there is another identical middle bracket assembly 44 between seating units 14B and 14C. For each additional seating unit 14 included in the chair assembly 10, one additional middle bracket assembly 44 is used.

Each middle bracket assembly 44 comprises a back connection member or plate 46, a seat connection member or plate 48, a tubular arm rest 50 projecting horizontally from the back connection plate 46, and a vertically oriented post 52 extending upwardly and perpendicular from the seat connection plate 48 to the arm rest 50. The middle bracket assembly 44 can be formed by bending a steel tube to form the arm rest section 50 and the post 52, and then welding the bent tube to the back connection plate 46 and the seat connection plate 48. The arm rest provides aesthetics, comfort, and psychological separateness to the users of the chair assembly 10.

The bracket assembly 44 is used to hold adjacent seating units 14 together by securing the back connection plate 46 to the adjacent seating units with fasteners 56 such as a T-nut mounted in the upper portion of the back support section 32 and a screw threaded through the back connection plate 46 into the T-nut. Preferably two fasteners 56 are used for each of the connected seating units 14 (four fasteners 56 for each back connection plate 46).

The seat connection plate 48 is similarly attached to the underside of the front portion of the seat support section 34 of the adjacent seating units 14 by means of four fasteners 58, each preferably comprising a T-nut 59A and a screw 59B. As best shown in FIG. 4, there are four fasteners 58, two for each of the adjacent seating units 14. The two forward fasteners 58 extend not only through the seat connection plate 48 and the seat support section 34, but also through the beam 20.

As best shown in FIG. 4, the top portion of the seat support section 34 has arcuate cutout portions or notches 62 on both of its edges to accommodate the vertical post 52 of the middle bracket assembly 44. This cutout notch 62 is provided also at the outside edges of the end seating units 14A and 14C even though they provide no practical advantage at that location since there is no vertical post 52. However, for interchangeability of the seating units 14, all seating units are provided with two notches 62.

For comfort, the front seating surface of the seating units 14 is covered with foam, such as polyurethane foam. In a preferred version of the invention, three separate foam layers 64 are provided against the shell-shaped seating units, each foam layer being about ½ inch thick. Each foam layer 64 is formed from polyurethane foam having,a density of about 2½ pounds per cubic foot. A bottom foam layer 64A has a firmness of 70 ILD, a middle foam layer 64B has a firmness of 30 ILD, and a top layer 64C has a firmness of 20 ILD. Thus the layers are of increasing firmness from top to bottom, the softer top layer providing comfort, and the firmer middle and bottom layers preventing "bottoming out" on the rigid shell 15 of the seating unit 14.

The foam is held in place on the shell 15 preferably by means of glue. Rather than having three separate foam layers, one single foam layer can be molded to provide the desired characteristics of rigidity and softness.

Each seating unit 14 can also comprise a fabric cover 66 for aesthetics and to protect the foam 64. Thus each seating unit can comprise the rigid wooden shell 15, three foam layers 64, and a cover 66. Preferably the cover is easily removed, and is held in place by a zipper 68 that is along the bottom edge of the front and sides of the seat support section 34.

Figure 9:
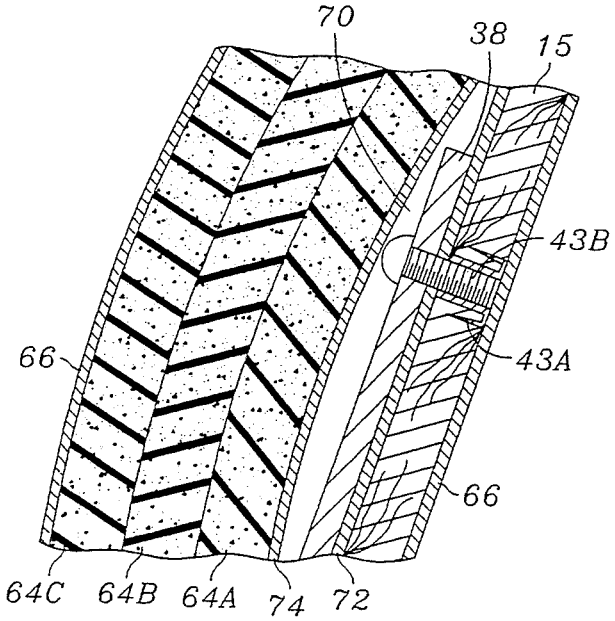
FIG. 9 is a horizontal sectional view taken on line 9—9 in FIG. 2 showing how the seat cover accommodates one of the plates linking adjacent backs or a back to a leg.

The cover 66 is slipped over the seating unit, including the back section 32 and seat support section 34, and is held in place with the zipper 68. Each cover 66 is preferably provided with a pair of elongated narrow pockets 70 to accommodate the end bracket 38 and the back connection plate 46 of the middle bracket 44. As best shown in FIG. 9, each pocket 70 is formed with two extra segments of fabric, an underlying segment 72 that is between the back connection plate 46 and the wooden shell 15, and an overlaying fabric segment 74 that is on top of the back connection plate 46. Thus in the region of the pocket 70, the cover 66 is four fabric layers thick. This pocket construction allows the seating units to be provided to the user completely upholstered, and then assembled in the field by merely sliding the brackets into the pockets and fastening them in place.

A significant advantage of the slip-on cover is that, because of the pockets 70 and zipper, it is easily removable and replaceable. Thus if a cover becomes soiled, it can easily be cleaned or replaced, without having to replace a complete seating unit.

Figure 5:
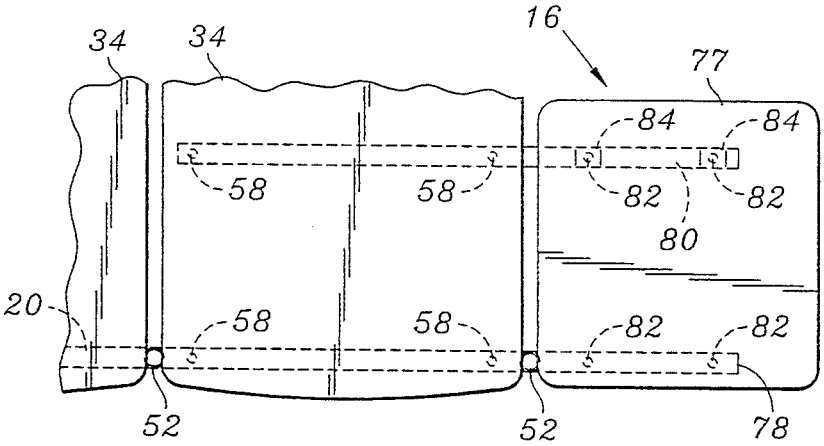
FIG. 5 is a partial top plan view, partly in section of the air assembly of FIG. 1 taken on line 5—5 of FIG. 1.

The optional end table assembly 16 comprises a horizontal table 77, preferably made of plywood or particle board, and two beams to support it in place, a forward beam 78 and a rear beam 80. As best shown in FIGS. 2 and 5, the forward beam 78 is welded to the outside of the front vertical segment 26A of the end leg 18, at an elevation matching that of the beam member 20 connected to the opposite side of the leg, and extends horizontally and is cantilevered therefrom. The rear beam 80 is fastened to the underside of the seat support section 34 of the end seating unit 14C. The table 76 is secured to the tops of the beams 78 and 80 by means of fasteners 82. Because the rear beam 80 is at a lower elevation than the front beam 78 due to the rearward tilt of the seat support section 34 of the end seating unit 14C, spacers 84 are placed on top of the rear beam 80 so that the table 76 is supported horizontally.

If desired, an additional table assembly 16 can be provided at the other end of the chair assembly 10 next to the end seating unit 14A. In addition, two or more similarly structured tandem chair assemblies can be adjoined off two or more sides of a single table by appropriately modifying the length and intersection of these beam extensions 78 and 80.

The tandem chair assembly shown in the figures has significant advantages in addition to those described above. It is an extremely structurally efficient system because the backs of the seating units take up most of the load by serving as parts of a segmented beam with a structural capacity corresponding to the depth of the joined portions of the back. The supplemental under-the-seat beam 20 not only serves to stiffen the seat fronts, but it also serves to maintain the horizontal alignment of the seat support sections. It is also the primary resistance to lateral loads and racking of the entire assembly.

Further, the substantially right angle orientation of the seating section to the back section of the seating units resist the tendency that the backs would otherwise have to bend around each intersection. Moreover, normally sitting on the seating units would have the tendency to change this right angle orientation. However the "L"-shaped configuration of the arm rest 50 and post 52 of the middle bracket assembly 44 reinforces the right angle orientation 88 of the seat section relative to the back section. This "L"-shaped configuration also tends to eliminate any fabrication induced warpage of the shells 15.

Another advantageous feature of the tandem chair assembly 10 is that only one separate horizontal beam is required due to the creation of an "integral" back beam provided by rigidly interconnecting the back support sections of the seating units. Use of only one beam reduces the weight, bulkiness, and cost of the chair assembly.

Another desirable feature of the tandem chair assembly 10 is that any tendency of the assembly to warp is rectified by the end legs 18 which sit flat on the floor. In fact, it is believed that the entire chair assembly 10 twists sufficiently along its full length to accommodate any irregularity in the floor so that leveling guides are not needed as they are needed in tandem chair assemblies supported on a main lateral structural support member.

The tandem chair assembly 10 can be provided as a knock-down unit. This is easily accomplished by merely shipping two or more seating units 14 that include the foam and the fabric, two end legs 18 with the "C" brackets 28 and the two end brackets 38 welded in place, the horizontal beam 20, one middle bracket assembly 44, an additional middle bracket assembly for each additional seating unit beyond three, and the necessary fasteners. If the tandem chair assembly 10 includes an end table assembly 16, then the forward table beam 78 (welded in place), rear table beam 80, spacers 84, and a horizontal table 76 are also provided.

While the present invention has been described in considerable detail with reference to certain preferred versions thereof, other versions are possible. For example, rather than cantilevering end tables off of the end legs, an extra seat and back unit can be cantilevered off the end.

In addition the end legs need not be loopshaped. For example each end leg need not include the bottom horizontal segment.

Therefore the spirit and scope of following claims should not be limited to the description of the preferred versions contained herein.

What is claimed is:

1. A tandem chair assembly comprising:

(a) a frame comprising a single pair of opposed leg members, a single horizontal beam extending between the leg members, and a beam connector for attaching the leg members to the horizontal beam;

(b) a plurality of separate seating units positioned side-by-side between the leg members, each seating unit having its own rigid back support section and seat support section, each seating unit being formed of a rigid material, the seat support section being connected to the back support section for transmitting vertical loads from the seat support section into the back support section;

(c) a leg connector for rigidly connecting each leg member to the back support section of the seating unit adjacent to the leg member;

(d) a back connector for rigidly connecting the back support sections of each pair of adjacent seating units together to form a rigid back beam for supporting the vertical loads in the back support sections; and (e) a seat connector for supporting each seat support section relative to the horizontal beam, the horizontal beam extending proximate a front extremity of each seat support section, wherein, when the chair has occupants seated proximate respective ones of the back support sections, the rigid back beam transmits most of the load on the chair assembly by the occupants to the single pair of opposed leg members, the single horizontal beam transmitting a minor part of the loading to the leg members.

2. The tandem chair assembly of claim 1 comprising sequential first, second, and third seating units, the first and third seating units being connected to a respective one of the single pair of leg members, the second seating unit being between the first and third seating units, a first one of the back connectors connecting the first and second seating units together, and a second one of the back connectors connecting the second and third seating units together.

3. The tandem chair assembly of claim 1 wherein each seating unit is comprised of formed plywood.

4. The tandem chair assembly of claim 1 or 3 wherein each seating unit comprises a removable cover.

5. The tandem chair assembly of claim 1 wherein the seating units are identical and interchangeable.

6. The tandem chair assembly of claim 1 wherein each of the leg member comprises a substantially rectangular loop having a top horizontal segment, a bottom horizontal segment, and two vertical segments, the bottom horizontal segment being adapted to rest on the floor and the top horizontal segment positioned to serve as an arm rest.

7. The tandem chair assembly of claim 1 wherein each back connector comprises a rigid connecting member fastened to the back support sections of the corresponding pair of adjacent seating units.

8. The tandem chair assembly of claim 1 or 7 wherein the back connector comprises for each pair of adjacent seating units a seat connection member attached to (i) the horizontal beam and (ii) the seat support section of the adjacent pair of seating units.

9. The tandem chair assembly of claim 7 wherein each back connector comprises a horizontal extension serving as an arm rest.

10. The tandem chair assembly of claim 1 wherein each back connector comprises an arm rest between the corresponding pair of adjacent seating units.

11. The tandem chair assembly of claim 1 including a table assembly comprising (i) a table projecting laterally from one of the leg members, and (ii) a table connector for attaching the table to the chair assembly.

12. The tandem chair assembly of claim 11 wherein the seat support section is tilted downwardly toward a rear portion thereof and the table connector comprises (i) a horizontal front table beam cantilevered from and attached to the leg member from which the table projects laterally, (ii) a rear table beam positioned rearwardly of the front table beam and cantilevered from and extending horizontally from the seat support section of the adjacent seating unit, the rear table beam being lower than the front table beam, (iii) an attachment for attaching the table to a top position the table beams, and (iv) a leveling member on the rear table beam so that the table is supported substantially horizontally.

13. The tandem chair assembly of claim 1 in which the beam connector comprises a bracket attached to each leg member, the bracket being sized to fit into the horizontal beam, the horizontal beam being placed over the bracket.

14. The tandem chair assembly of claim 13 wherein the beam connector includes a pin extending through the bracket and horizontal beam.

15. The tandem chair assembly of claim 1 comprising a seat connection member connecting the seat support sections of each pair of adjacent seating units together and to the horizontal beam, and a seat back connector rigidly connecting each back connector to the corresponding seat connection member for maintaining a selected angle between the back support section and the seat support section of each seating unit.

16. The tandem chair assembly of claim 15 wherein the angle between the back support section and the seat support section is about a right angle.

17. The tandem chair assembly of claim 15 or 16 wherein the seat back connector comprises (i) an armrest projecting substantially horizontally from the back connector and (ii) a vertical post attached to the armrest and the seat connection member.

18. The tandem chair assembly of claim 17 where each seating unit is in close proximity to each adjacent seating unit, and each seating unit has a pair of opposed cutouts sized and located to accommodate the posts.

19. The tandem chair assembly of claim 1 wherein the back connector comprises a thin plate extending between each pair of adjacent seating units.

20. The tandem chair assembly of claim 1 comprising in addition a seat connection member connecting the seat support sections of each pair of adjacent seating units together and to the horizontal beam, a vertical post extending upwardly from the seat connection member, and an armrest projecting substantially horizontally from the vertical post.

21. The tandem chair assembly of claim 20 wherein each seating unit is in close proximity to each adjacent seating unit, and each seating unit has a pair of opposed cutouts sized and located to accommodate the post.

22. The tandem chair assembly of claim 20 or 21 wherein the seat connection members are thin plates.

23. A tandem chair assembly comprising:

(a) a frame comprising a single pair of opposed support leg members, a single elongated horizontal beam extending therebetween, and a beam connector for attaching the leg members to the horizontal beam;

(b) a plurality of seating units positioned side-by-side between the leg members, each seating unit having a back support section and a seat support section meeting at an angle, each seating unit being formed of a rigid material, the seat support section being connected to the back support section for transmitting vertical loads from the seat support section into the back support section;

(c) a pair of end brackets for rigidly connecting each leg member to the back support section of a seating unit adjacent to the leg member;

(d) a seat connector for supporting each seat support section relative to the horizontal beam, the horizontal beam extending proximate a front extremity of each seat support section; and (e) a middle bracket assembly for rigidly connecting each respective pair of adjacent seating units together, each middle bracket comprising:

(i) a back connection member rigidly connecting the back support sections of the pair of adjacent seating units together, (ii) a seat connection member connecting the seat support sections of the pair of adjacent seating units and to the horizontal beam, and (iii) a seat back connector rigidly connecting the back connection member to the seat connection member for maintaining the angle between the back support section and the seat support section of the pair of adjacent seating units, wherein the back connection members and the back support sections form a rigid beam for supporting the vertical loads of sufficient strength for transmitting most of the load from occupants of the chair assembly to the single pair of leg members.

24. The tandem chair assembly of claim 23 wherein each seating unit comprises foam attached thereto for comfort and a removable cover for an attractive appearance, the cover comprising pockets to accommodate respective back connection members and end brackets, each pocket comprising an underlying segment of fabric on top of one of the respective connection member and end bracket and an underlying segment of fabric between one of the respective connection member and end bracket to completely cover one of the respective connection member and end bracket.

25. The tandem chair assembly of claim 23 wherein the angle between the back support section and the seat support section is about a right angle.

26. The tandem chair assembly of claim 23 or 25 wherein the seat back connector comprises an arm rest projecting substantially horizontally from the back connection member and a vertical post attached to the arm rest and the seat connection member.

27. The tandem chair assembly of claim 26 wherein each seating unit is in close proximity to each adjacent seating unit, and each seating unit has a pair of opposed cutouts sized and located to accommodate the posts.

28. The tandem chair assembly of claim 23 or 25 wherein the seating units are identical and interchangeable.

29. A kit for forming a tandem chair assembly, the structural elements of the kit consisting essentially of:

(a) a single pair of leg members;

(b) a single elongated beam adapted for extending horizontally between the leg members;

(c) a beam connector for attaching the horizontal beam to the leg members so that the leg members can support the horizontal beam parallel and above a floor surface;

(d) a plurality of substantially identical and integral seating units, each seating unit being monocoque structure having a back support section and a seat support section, each seating unit being formed of a rigid material for transmittinq vertical loads from the seat support section to the back support section, wherein the horizontal beam is sized that the seating units can be mounted on the horizontal beam side-by-side between the leg members;

(e) a leg connector for rigidly connecting each leg member to the back support section of one of the seating units; and (f) connection means comprising (i) respective back connection plates for rigidly securing together the back support sections of each pair of seating units that are assembled adjacent to each other to form a rigid beam for supporting the vertical loads, wherein, when the chair has occupants seated proximate the back support sections, the rigid beam takes up most of the load on the chair assembly by the occupants to the single pair of opposed leg members, (ii) corresponding brackets for securing the seat support section of each adjacent pair of seating units to the horizontal beam and for securing adjacent seat support sections to each other with the horizontal beam extending proximate a front extremity of each seat support section, and (iii) an extension rigidly connected between each connection plate and the corresponding bracket for securing the seat support sections, the extension being adapted to serve as an armrest, whereby the back support sections and the back connection plates provide sufficient structural support for the assembly in the absence of legs between the single pair of leg members and in the absence of beams directly supporting the back support sections.

30. The kit of claim 29 wherein each seating unit is comprised of formed plywood.

31. The kit of claim 29 wherein the seating units are identical and interchangeable.

32. The kit of claim 29 including a table adapted for mounting and extending laterally from one of the leg members and away from the chair assembly, and a table connector for attaching the table to the leg member, and one of the seating units.

33. The tandem chair assembly of claim 1, 5, 23 or 25, wherein the seating units are of monocoque construction.

* * * * *